United States Patent [19]

Petrov

[11] 4,237,705

[45] Dec. 9, 1980

[54] LOOP-FORMING INSTRUMENT OF KNITTING MACHINE

[76] Inventor: Evgeny I. Petrov, Belovezhskaya ulitsa, 91, kv. 77, Moscow, U.S.S.R.

[21] Appl. No.: 855,298

[22] Filed: Nov. 28, 1977

[30] Foreign Application Priority Data

Dec. 16, 1976 [SU] U.S.S.R. ..... 2426701

[51] Int. Cl.[2] ..... D04B 35/04

[52] U.S. Cl. ..... 66/123

[58] Field of Search ..... 66/123, 124, 121, 90

[56] References Cited

U.S. PATENT DOCUMENTS

| | | | |
|---|---|---|---|
| 841,678 | 1/1907 | Elder | 66/123 X |
| 995,304 | 6/1911 | Swinglehurst | 66/123 X |
| 1,087,954 | 2/1914 | Kilbourn et al. | 66/123 X |
| 1,198,280 | 9/1916 | Rush | 66/123 X |
| 3,875,767 | 4/1975 | Kopal et al. | 66/123 |
| 3,994,145 | 11/1976 | Stolz | 66/123 |
| 4,068,500 | 1/1978 | Kohorn | 66/123 |

*Primary Examiner*—Wm. Carter Reynolds
*Attorney, Agent, or Firm*—Steinberg & Raskin

[57] ABSTRACT

A loop-forming instrument relates to knitting machines wherein cam assemblies are used for displacing the loop-forming instruments, and includes a stem having a working end, portions of variable cross-section, a butt, a tail and a portion widening towards the working end. Disposed in the stem, intermediate of the butt and the widening portion, is a portion of constant cross-section abruptly changing to a narrowed part of the widening portion, the width thereof being considerably less than the width of the portion of constant cross-section. This makes it possible to strengthen the butt, to minimize concentration of stress in the working end set up in the moving loop-forming instrument and, thereby, to prolong the useful life thereof.

5 Claims, 7 Drawing Figures

LOOP-FORMING INSTRUMENT OF KNITTING MACHINE

The present invention relates to knitting machines, wherein Cam assemblies are used for displacing the loop-forming instruments and, more particularly it relates to loop-forming instruments (latch needles, master jacks, pushers) used therein.

Each loop-forming instrument (the latch needle, the master jack, the pusher) comprises a stem having a working end (for instance, a hook with a latch, for the needles), portions of variable cross-section, a butt and a tail. Provision of the portions of variable cross-section in the stem is conditioned by the loop-forming process and the latch attachment. These portions of variable cross-section are shaped as a wedge with a narrowed part thereof directed towards the working end.

In the course of knitting, the loop-forming instruments, while moving, pound against the cams of the cam assemblies which gives rise to stress shock waves propagating along the stem of the loop-forming instrument causing, at a definite rate of collisions, damage to the working end thereof. This damage is the main factor restricting operating speeds of the knitting machine.

Besides, due to availability of the portions of variable cross-section in the stem, the narrowed parts of which are orientated towards the working end, shock stresses prove to be increased and concentrated in the zone of the working end.

At present, there are known loop-forming instruments, wherein owing to a modified shape of the stem it is possible to partially decrease concentration of stresses in the zone of the working end, for instance, a latch needle with a stem having a portion of constant cross-section and a widening portion, for instance, a wedge-shaped portion, formed in the place of transition of the stem to the butt base, with a wide side facing the needle hook (the working end) and with a narrow side facing the butt.

So, the Inventor's Certificate of the USSR No. 112,767, Cl. 25a, 19/01 deals with a latch needle with a stem having a portion of constant cross-section and a widening portion, for instance, a wedge-shaped portion, formed in the place of transition of the stem to the butt base, with a wide side facing the needle hook (the working end) and with a narrow side facing the butt.

Due to such a structure of this needle a partial reflection and attenuation of shock waves is attainable which enables to step up the speed of the knitting machine by 30–40% without the needle working end being damaged. However, since the stem is of one and the same cross-section along almost the entire length thereof, it is not capable of eliminating stress concentration in the needle hook because stress shock waves, while propagating along such a stem, do not undergo any changes. The presence of the narrow portion in the butt base effects the cross-section thereof, i.e. the increase of the speed of collisions between the butt and the cams of the cam assembly may render the former broken.

There are also known needles with recesses in the zone of the butt.

There are also known needles with recesses in the zone of the heel (cf. Application of FRG No. 2,229,858, D04b 35/04, Inventor's Certificate of the USSR No. 489,824, D04 b 35/04). These needles, however, are capable of attenuating the stress shock waves but slightly, whereas the recesses sharply decrease the strength of the butt.

There is known a needle, which is provided with recesses of various shapes in the stem.

There is known a needle (cf. U.S. Pat. No. 346,237, Cl. 66-121) which is provided with recesses of various shapes in the stem. Due to the recesses, the weight of the needle is lowered and the speed of the knitting machine increased. At the same time, the recesses in the stem form portions of constant cross-section therein, which cannot eliminate concentration of the stress shock waves in the working end, whereas the recesses in the needle butt affect the cross-section thereof.

To avoid diminishing of the heel strength, with the recesses provided therein, the width of the heel must be increased. This increases the vertical travel of the needle, with the decrease of the number of the loop-forming instruments and the operating speed of the machine being a result.

The principal object of the present invention is to provide a loop-forming instrument which will be reliable in operation.

Another object of the present invention is to provide a loop-forming instrument which will enable to increase substantially the speed of the knitting machines.

These other objects are attained by that in a loop-forming instrument of a knitting machine comprising a stem member having a working end, portions of variable cross-section, a primary portion widening towards the working end, a butt and a tail, in accordance with the invention, provided intermediate of the butt and the widening portion of the stem member is a portion of constant cross-section abruptly changing to the narrowed part of the widening portion with a width thereof considerably less than the width of the portion of constant cross-section.

According to the invention, the abrupt change of the portion of constant cross-section to the widening portion takes place at an angle close or equal to 90° relative to the longitudinally extending sides of the constant cross-section portion of the stem member.

It is preferable that some secondary portions of the stem member be provided with variable cross-sections, these portions being provided between the above-mentioned primary widening portion and the working end of the stem member, these variable cross-section portions also widening towards the working end with an abrupt change of the underlying portions to the overlying portions.

Thus, the provision of the portion of constant cross-section in the stem member near the butt makes it possible to strengthen the butt and, thereby, to prolong the useful life of the loop-forming instrument. The provision of the primary and secondary portions widening towards the working end lengthwise of the stem member with the further provision of an abrupt change of one to another contributes to attenuation in each of these portion of the shock wave propagating from the butt upwards the stem member, since a part of this wave is reflected from the places of abrupt change of one portion to another. As a result, concentration of stresses in the working end sharply decreases, whereby the reliability of operation of the loop-forming instrument and of the knitting machine is secured and the operating speed of the latter is increased.

It is preferable also to locate between the primary and secondary widening portions of the stem the portions of constant cross-section variable in shape and sequence.

The side surfaces of the stem member defining the widening portions angularly extend with respect to each other an amount in the range of 5–40°.

It is desirable, also that the side surfaces of the stem member forming the widening portions thereof be made curvilinear. However, the widening portions of the stem may be formed by the curvilinear side surfaces and the rectilinear side surfaces as well.

Given below is a detailed description of the present invention with reference to the accompanying drawings, wherein.

Figure 4A:
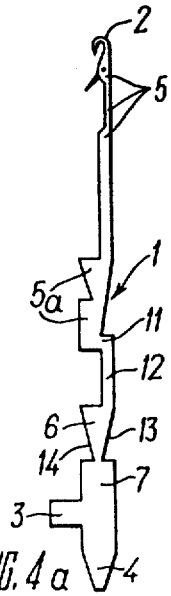
Figure 4B:
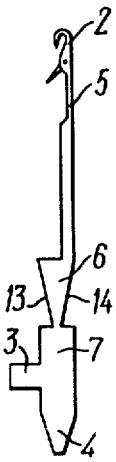

FIG. 4*a, b, c, d* shows latch needles with stems made up of widening portions of various shapes.

Figure 2:
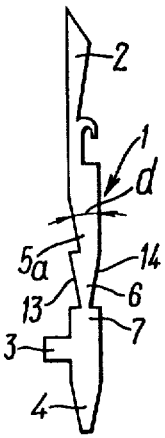
FIG. 2 shows a master jack according to the invention.
Figure 3:
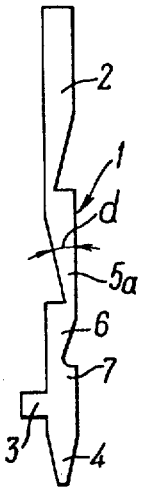
FIG. 3 shows a pusher according to the invention.

The loop-forming instrument, for instance, the latch needle (FIG. 1), the master jack (FIG. 2) and/or the pusher (FIG. 3) comprises a stem member 1, having a working end 2, a butt 3 and a tail 4.

The stem member 1 is partially defined by portions generally designated of variable cross-section and of a primary portion 6 widening towards the working end 2, with a portion 7 of constant cross-section provided intermediate of the primary widening portion 6 of the stem and the butt 3, this portion abruptly changing to a narrowed part of the primary widening portion 6 with a width "a" thereof many times (for instance, 1.5–3 times) less than a width "b" of the portion 7 of constant cross-section. An abrupt change of the portion 7 of constant cross-section tot the primary widening portion 6 takes place along a line 8 extending at an angle close or equal to 90° relative to a side surface 9 of the portion 7.

Figure 1:
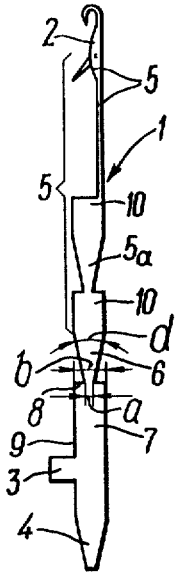
FIG. 1 shows a latch needle according to the invention.

In the stem member 1 some of the portions 5 which have been generally designated 5 of variable cross-section as well as the primary widening portion 6 widen towards the working end 2 as shown in FIGS. 1 and 4*a* these secondary widening portions are designated by reference numbers 5*a* in the several figures. The remaining part of the portions 5 of variable cross-section, designated 5*b*, adjoining the working end 2 of the loop-forming instrument complies with the adopted form ensuring normal operation of the working end 2 and attachment of the needle latch.

The primary and secondary widening portions 6 and 5*a* respectively of the stem member 1 may be arranged successively over almost the entire length thereof with an abrupt change of the underlying portions to the overlying ones as shown in FIGS. 1 and 4*a* or, otherwise, between the widening portions 6 and 5*a* there may be provided portions 10 of constant cross-section as shown in FIG. 1. In this case, the portions of constant cross-section may have different shapes, for instance, portions 11 and 12 of FIG. 4*a* and arranged in different sequence, i.e. every other widening portion or one after another as shown in FIG. 4*a*. It is understood that constant cross-section portions 10, 11, 12 constitute particular portions of those portions generally designated 5. Further, referring to the embodiment illustrated in FIG. 4*a*, portion 12 constitutes an additional constant cross-sectional width portion which is located immediately above the primary widening portion 6 and which intersects the upper wide width section thereof. The additional constant cross-sectional width portion has a narrower width than portion 7 and has a center-line which is transversely displaced with respect to the longitudinal central axis along which portion 7 extends.

Figure 4C:
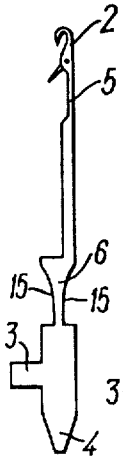
Figure 4D:
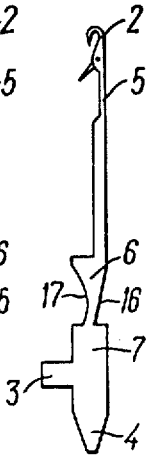

The side surfaces of the widening portions 6 or 5*a* angularly extend with respect to each other towards the working end 2, at an angle $\alpha$, which is in the range of 5–40°. Further, side surfaces 13 and 14 of the primary widening portion 6 may be rectilinear as is shown in FIGS. 1, 2, 3, 4*a* 4*b* or they may be curvilinear surfaces 15 as is shown in FIG. 4*c*. The primary widening portion 6 may be formed by a combination of rectilinear side surfaces 16 and curvilinear side surfaces 17 as in FIG. 4*d*. However, this applies also to the secondary widening portions 5*a* not shown.

With the knitting machine operating, the butts 3 of the loop-forming instruments projecting from the slots of the rotatable needle bed bump into the guiding surfaces of the stationary cams of the cam assembly and under the action thereof the loop-forming instruments displace in the slots of the needle bed, whereby participating in the process of loop forming.

As the butt 3 collides with the cams, shock waves start propagating along the stem member 1 of the loop-forming instrument. These waves are partially reflected from the places of an abrupt change of one portion of the stem member to another, while some of the waves upon arrival at the overlying portions propagate along the wide portion thereof and are thereafter again reflected from the place of an abrupt change, Thus, only a minor part of the shock wave arrives at the working end 2 which cannot cause damage thereto.

Thus, it is seen that a loop-forming instrument for use in a knitting machine is provided comprising an elongate stem member 1 having a rectilinear longitudinal central axis 100, stem member 1 having an upper working end portion 2 and a lower tail end portion 4. A butt portion 3 adjacent the tail end portion 4 extends substantially transversely to the longitudinal central axis of the stem member. A first portion 7 having a constant transverse cross-sectional width extends upwardly for a predetermined distance along the rectilinear longitudinal central axis 100 and is symmetrically formed with respect thereto. A primary widening portion 6 has a transverse cross-sectional width which increases from a lower narrow width section in the direction of the working end portion 2 of the stem member, the primary widening portion 6 being located immediately vertically adjacent to the first constant cross-sectional width portion 7 such that the narrow width section abruptly intersects the upper end of the constant width portion at 8 (FIG. 1). Further, the width of the intersecting narrow width section is preferably less than one half the width of the first constant width portion. Additional portions, generally designated 5, have variable transverse cross-sectional widths and extend between the upper ends of the primary widening portion 6 and the upper working end portion 2 of the stem member 1.

It is further seen that the lower narrow section of the primary widening section intersects the upper end of the constant width portion 7 such that the cross-sectional width of the stem member at that point of intersection abruptly changes. More particularly, the constant width portion 7 terminates at its upper end at horizontally extending side surfaces which form an angle of about 90° with the side surfaces of portion 7. This has been found to provide an extremely effective reflection of shock waves which would otherwise be propagated along the stem member as described above.

Further, at least some of the additional portions, generally designated 5, comprise secondary widening portions 5*a* which themselves have transverse cross-sectional widths which increase from a lower narrow width section in the direction of the working end portion 2 of stem member 1. The lower narrow width sections of these secondary widening portions 5*a* abruptly intersect the upper end of the portions immediately vertically below them to provide further reflection of the shock waves which would otherwise be propagated along stem member 1.

The primary and secondary widening portions are defined by side surfaces which preferably extend at an angle with respect to each other in the range of from 5° to 40°.

It should be understood, of course, that various modifications and structural changes may be made in the loop-forming instrument of the knitting machine without departing in any way from the spirit and scope of the present invention.

What is claimed is:

1. A loop-forming instrument for use in a knitting machine comprising an elongate stem member having a rectilinear longitudinal central axis, said stem member having an upper working end portion, a lower tail end portion, a butt portion intersecting said tail end portion extending substantially transversely to said longitudinal central axis, a first portion having a constant transverse cross-sectional width extending upwardly for a predetermined distance from said butt portion along said rectilinear longitudinal central axis and being symmetrically formed with respect thereto, a primary widening portion having a transverse cross-sectional width which gradually increases from a lower narrow width section to an upper wide width section in the direction of said working end portion, said primary widening portion being symmetrically formed with respect to said longitudinal central axis, said primary widening portion being located immediately vertically adjacent to said first constant cross-sectional width portion such that the narrow width section abruptly intersects the upper end of said constant width portion, the width of said intersecting narrow width section being considerably less than the width of said first constant width portion, and additional portions having variable transverse cross-sectional widths extending between the upper end of said primary widening portion and the upper working end portion of said stem member, said additional portions including an additional constant cross-sectional width portion located immediately above said primary widening portion and intersecting said upper wide width section thereof, said additional constant cross-sectional width portion being of a narrower width than said first portion and having a longitudinally extending center-line, said center-line being transversely displaced relative to said longitudinal central axis along which said first constant cross-sectional width portion extends.

2. A loop-forming instrument as recited in claim 1 wherein said first constant cross-sectional width portion is defined by a pair of vertically extending side surfaces and wherein the upper end of said first constant cross-sectional width portion which is abruptly intersected by said primary widening portion narrow width section is defined by a horizontally extending surface extending at an angle of substantially 90° to said vertically extending side surfaces.

3. A loop-forming instrument as recited in claim 1 wherein at least some of said additional portions each comprise a secondary widening portion having a transverse cross-sectional width which increases from a lower narrow width section in the direction of said working end portion, the lower narrow width section of each of said secondary widening portions abruptly intersecting the upper end of a portion immediately vertically therebelow, the width of the upper end of the latter being considerably greater than the lower narrow width section of said secondary widening portion.

4. A loop-forming instrument as recited in claim 3 wherein said additional constant cross-sectional width portion is located between a pair of widening portions.

5. A loop-forming instrument as recited in claim 3 wherein said widening portions are defined by side surfaces extending at an angle with respect to each other in the range of from 5° to 40°.

* * * * *